US006424202B1

(12) United States Patent
Bartlett

(10) Patent No.: US 6,424,202 B1
(45) Date of Patent: Jul. 23, 2002

(54) NEGATIVE VOLTAGE GENERATOR FOR USE WITH N-WELL CMOS PROCESSES

(75) Inventor: Donald M. Bartlett, Ft. Collins, CO (US)

(73) Assignee: LSI Logic Corporation, Milpitas, CA (US)

( * ) Notice: Subject to any disclaimer, the term of this patent is extended or adjusted under 35 U.S.C. 154(b) by 1379 days.

(21) Appl. No.: 08/738,916

(22) Filed: Oct. 28, 1996

Related U.S. Application Data

(63) Continuation of application No. 08/534,088, filed on Sep. 26, 1995, now abandoned, which is a continuation of application No. 08/193,833, filed on Feb. 9, 1994, now abandoned.

(51) Int. Cl.[7] ..... G05F 3/02
(52) U.S. Cl. ..... 327/536; 327/536
(58) Field of Search ..... 327/91, 94, 124, 327/306, 307, 331, 390, 534, 535, 536, 537, 538, 540, 589, 43

(56) References Cited

U.S. PATENT DOCUMENTS 4,208,595 A 6/1980 Gladstein et al. ..... 307/297
4,344,003 A * 8/1982 Harmon et al. ..... 327/538
4,433,253 A 2/1984 Zapisek ..... 307/297
4,485,433 A 11/1984 Topich ..... 363/60
4,553,047 A 11/1985 Dillinger et al. ..... 307/297
4,736,121 A * 4/1988 Cini et al. ..... 327/536
5,041,739 A * 8/1991 Goto ..... 327/537
5,168,174 A * 12/1992 Naso et al. ..... 327/540
5,184,030 A * 2/1993 Chung et al. ..... 327/537
5,210,446 A * 5/1993 Niuya et al. ..... 327/537
5,247,208 A * 9/1993 Nakayama ..... 327/537
5,347,171 A * 9/1994 Cordoba et al. ..... 327/537
5,347,172 A * 9/1994 Cordoba et al. ..... 327/537

* cited by examiner

*Primary Examiner*—Terry D. Cunningham

(57) ABSTRACT

A CMOS negative voltage generator is provided which uses N-well technology. A positive voltage generator charges a load capacitor to a doubled voltage level. A first cycle of operation charges an output capacitor to a potential equal to the difference between the doubled voltage and the original voltage source. A second cycle of operation references the previously positive reference node of the output capacitor to ground level, and lets the negative node of the capacitor float to a potential equal in magnitude to the original power source, however now being negative with reference to ground. The negative voltage generator is ideal for driving a low impedance p-channel MOSFET. The negative voltage generator is ideal in low voltage circuits, including those with three volt supplies.

6 Claims, 3 Drawing Sheets

FIG._1
(PRIOR ART)
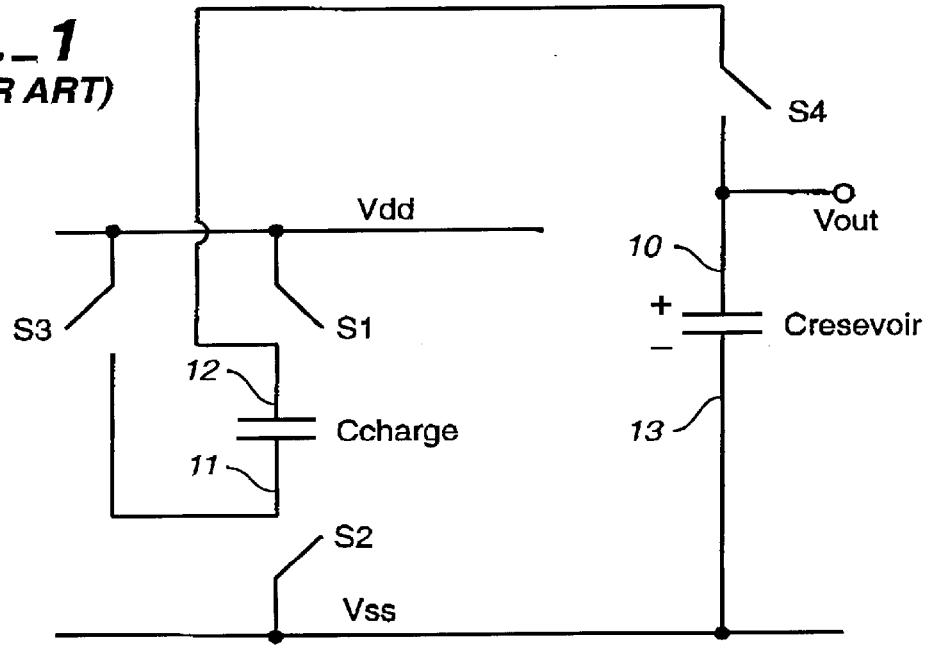
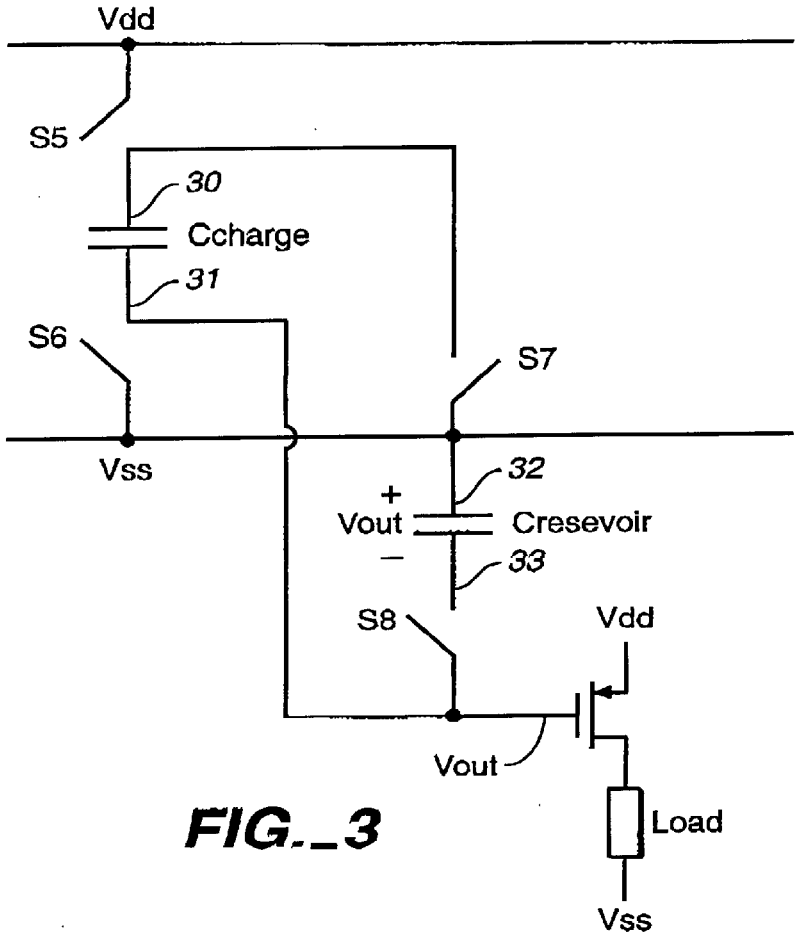
FIG._3

NEGATIVE VOLTAGE GENERATOR FOR USE WITH N-WELL CMOS PROCESSES

This is a continuation of application Ser. No. 08/534,088 filed Sep. 26, 1995 now abandoned, which is a continuation of application Ser. No. 08/193,833 filed Feb. 9, 1994, now abandoned.

FIELD OF THE INVENTION

This invention relates to a negative voltage generator, and more particularly to a negative voltage generator for use in a p-substrate semiconductor device using N-well CMOS technology.

BACKGROUND OF THE INVENTION

The equivalent circuit diagram of a conventional positive voltage doubler circuit for generating a positive doubled voltage is illustrated in FIG. 1. A charge capacitor $C_{charge}$ has a first node 12 connected to one side of switch S4, and a second node 11 connected to one side of switches S2 and S3. A reservoir output capacitor $C_{reservoir}$ has a first node 10 connected to the other side of switch S4, and a second node 13 connected to the other side of switch S2. The potential of the second node 13 of the reservoir capacitor $C_{reservoir}$ will be referred to as $V_{ss}$. The other sides of switches S1 and S3 are connected together, and the potential at this connection will be referred to as $V_{dd}$. The first node 10 of the reservoir capacitor $C_{reservoir}$ is also the output terminal $V_{out}$ of the positive voltage doubler circuit.

The conventional positive voltage doubler circuit illustrated in FIG. 1 is operated in two phases. During the first phase, switches S1 and S2 are closed while switches S3 and S4 are opened. During this period of time the charge capacitor $C_{charge}$ is charged to a potential of $(V_{dd}-V_{ss})$. This provides an accumulated charge Q in the charge capacitor $C_{charge}$ according to the following equation:

$$Q=(V_{dd}-V_{ss})*C_{charge} \quad \text{Eq. 1}$$

During the second phase switches S1 and S2 are opened and switches S3 and S4 are closed. All four switch transistors S1–S4 are switched using a control signal, typically generated by an oscillator. The time period of the second phase does not overlap the time period of the first phase. During the second phase, the charge Q that was previously stored in the charge capacitor $C_{charge}$ during the first phase is transferred to the reservoir capacitor $C_{reservoir}$.

A continual cycling between the first phase and the second phase will pump the output voltage level $V_{out}$ of the first node 10 of the reservoir capacitor $C_{reservoir}$ according to the following equation:

$$V_{out}=2*(V_{dd}-V_{ss}) \quad \text{Eq. 2}$$

This equation assumes that there is no load present.

A conventional CMOS formation is shown in FIG. 2, which illustrates a typical cross section of a p-type substrate having an n-type isolated well. A p-channel transistor 25 (switch) is formed in an N-well 21 of a p-substrate 22. An n-channel transistor 23 (switch) is also formed in the p-substrate 22.

Inherent to any n-channel transistor are parasitic diodes. The N-well itself 21 forms a parasitic diode 30 with the P-substrate 22. Usually, the substrate 22 is connected to the voltage potential $V_{ss}$, which is ground in most systems. The N-well 21 can be connected to any potential above $V_{ss}$ as long as the reverse biasing of the junction between the N-well 21 and the p-substrate 22 is less the break down voltage.

Parasitic diodes are also formed between sources and drains of the transistors, and the P-substrate or N-well in which they are formed. The N+ source and drain regions 24, 26 form parasitic diode 28*a*, 28*b* with the P-substrate 22. The N+ source and drain regions 24, 26 form the cathodes while the N-well 21 forms the anodes. Similarly, parasitic diodes 29*a* and 29*b* are formed in the p-channel transistor 25 between the source and drain regions 27, 20 and the N-well 21.

In the circuit illustrated in FIG. 1, the voltage doubler requires one p-channel switch transistor S4 and three n-channel switch transistors S1, S2 and S3. It is the parasitic diodes 28*a* and 28*b* which determine the channel formation of the switches. When switch S4 is a p-channel transistor in an N-well, the N-well can be biased to the output voltage $V_{out}$.

In certain circumstances, a negative voltage generator is desirable. However, a negative voltage generator is not preferably made in a p-type substrate having n-type isolated wells by reversing referenced voltages of the positive voltage doubler, because of parasitic diodes.

A conventional negative voltage generator is illustrated in FIG. 3. The operation of the negative voltage generator is similar to that of the conventional positive voltage doubler. A charge capacitor $C_{charge}$ has first node 30 connected to one side of switches S5 and S7, and a second node 31 connected to one side of switches S6 and S8. The other side of switch S5 is referenced to the positive voltage level $V_{dd}$, and the second side of switch S6 is referenced to the voltage level $V_{ss}$ (usually ground). The other side of switch S7 is connected to $V_{ss}$.

A reservoir capacitor $C_{reservoir}$ has a first node 32 connected to the $V_{ss}$ potential, and a second node 33 connected to the other side of switch S8. The second node 33 of the reservoir capacitor $C_{reservoir}$ provides the output voltage $V_{out}$ of the conventional negative voltage generator.

The negative voltage generator operates in two cycles. During the first cycle switches S5 and S6 are closed while switches S7 and S8 are opened. This allows the charge capacitor $C_{charge}$ to be charged with a positive voltage of $(V_{dd}-V_{ss})$ appearing at the first node 30 and a voltage $V_{ss}$ at the second node 31. During the second cycle, which does not overlap the first cycle, switches S5 and S6 are opened and switches S7 and S8 are closed. This allows the charge which was previously stored on the charge capacitor $C_{charge}$ to be transferred to the reservoir capacitor $C_{reservoir}$. The continuous cycling between the first cycle and the second cycle generates a negative voltage with respect to $V_{ss}$ at the output $V_{out}$ of the negative voltage generator.

The conventional negative voltage generator is not preferably formed in a p-substrate using an N-well process because of the aforementioned parasitic diodes. For example, if switch S8 was made from an n-channel transistor 23 as shown in FIG. 2, the N+drain region 24 would be connected to a negative voltage $V_{out}$ while the substrate was connected to a higher voltage $V_{ss}$. The parasitic diode 28*b* of the transistor will be forward biased, and the output voltage $V_{out}$ will be clamped to a maximum of one diode voltage drop below $V_{ss}$. Therefore, the negative voltage generator is conventionally implemented with a P-well CMOS process.

SUMMARY OF THE INVENTION

It is an object of the invention to provide a negative voltage generator using N-well CMOS technology which drives a p-channel output driver transistor having a low output impedance.

It is a further object to provide a negative voltage generator using N-well CMOS technology which can generate a voltage more negative than a parasitic diode voltage drop.

To solve these and other objects, a negative voltage generator is provided using an N-well CMOS process which is particularly useful for low voltage applications and low impedance applications.

A positive voltage doubler circuit using N-well CMOS technology is provided in a negative voltage generator. The positive voltage generator charges a load capacitor to a doubled voltage level. The negative voltage generator then implements two cycles by which a negative voltage is generated. The first cycle charges an output capacitor to a potential equal to the difference between the doubled voltage and the original voltage source. A second cycle then changes the positive reference node of the output capacitor to be at ground level, and lets the negative reference node of the output capacitor float to a potential equal in magnitude to the original power source, however it now being a negative voltage with reference to the ground.

The negative voltage generator according to the present invention eliminates the limitation of the achievable negative voltage being the parasitic diode voltage drop which exists when implementing a negative voltage generator using N-well CMOS technology.

BRIEF DESCRIPTION OF THE DRAWINGS

The above objects and other advantages of the present invention will become more apparent from the detailed description of the preferred embodiments thereof with reference to the attached drawings, in which:

FIG. 1 is an equivalent circuit diagram of a conventional positive voltage doubler circuit;

FIG. 3 is an equivalent circuit diagram of a conventional negative voltage generator.

DESCRIPTION OF THE PREFERRED EMBODIMENTS

Figure 2:
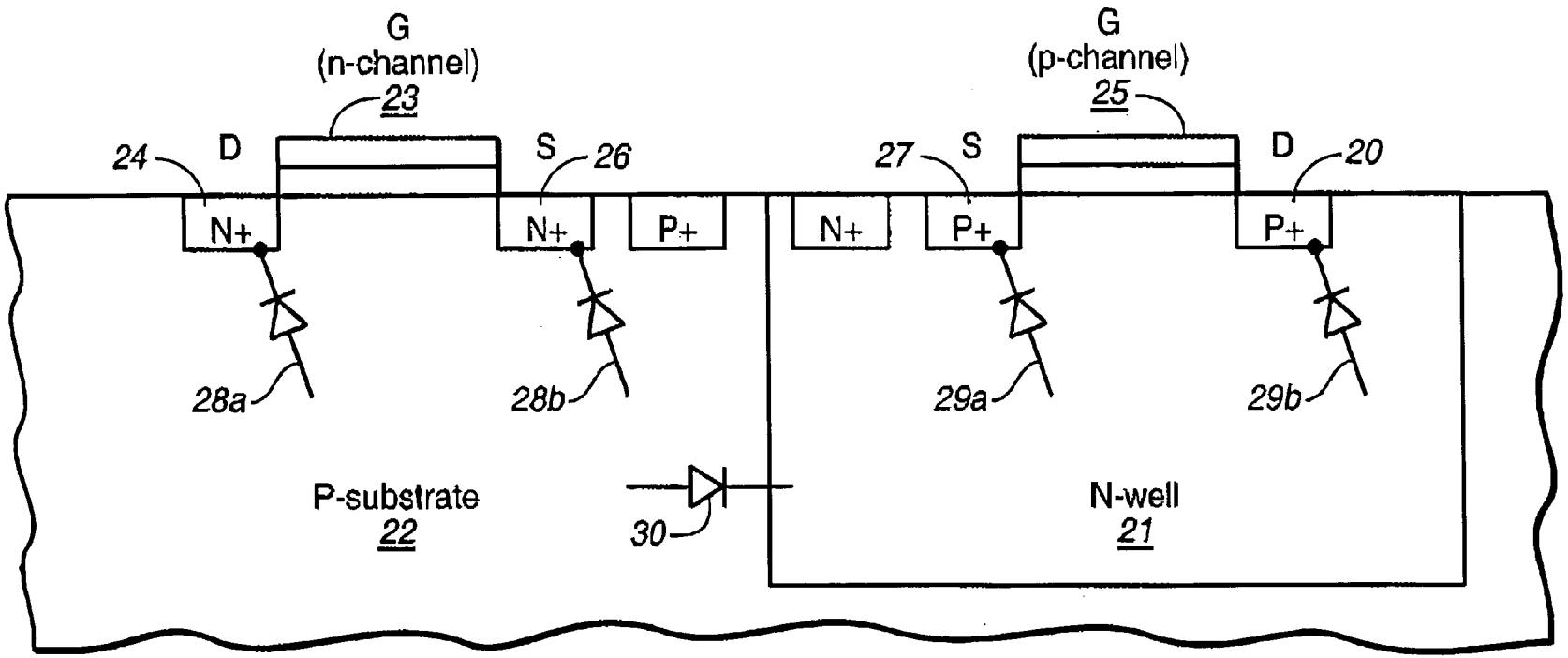
FIG. 2 is a cross-sectional view of a conventional N-well CMOS semiconductor device.
Figure 4:
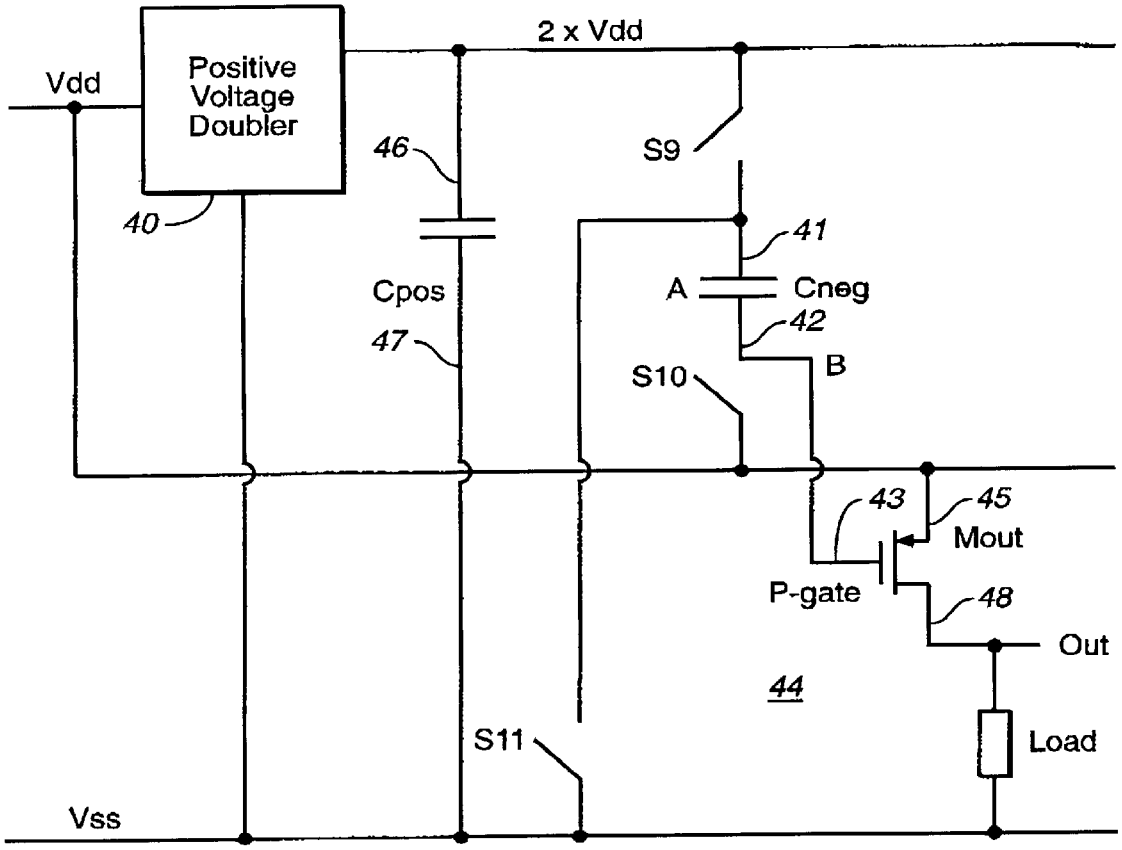
FIG. 4 is an equivalent circuit diagram of the negative voltage generator in accordance with the present invention.

FIG. 4 shows an equivalent circuit diagram of a negative voltage generator circuit formed using N-well CMOS technology in accordance with the present invention.

A positive voltage doubler 40 using N-well CMOS technology provides a doubled positive voltage ($2\times V_{dd}$) from a positive voltage source $V_{dd}$ having a reference voltage of $V_{ss}$ which is ground in most systems. The positive voltage doubler 40 charges a load capacitor $C_{POS}$ so that the first node 46 of the load capacitor $C_{POS}$ is charged to the doubled positive voltage ($2\times V_{dd}$), with the second node 47 of the load capacitor $C_{POS}$ being referenced to the voltage level $V_{ss}$.

An output capacitor $C_{NEG}$ has a first node 41 connected to one side of switches S9 and S11. The other side of switch S11 is connected to $V_{ss}$, and the other side of switch S9 is connected to the doubled positive voltage ($2\times V_{dd}$). The second node 42 of the output capacitor $C_{neg}$ is connected to one side of switch S10 and to the gate 43 of an output device 44.

In the preferred embodiment, the output device 44 is a p-channel transistor, and more preferably a MOSFET. The source 45 of the MOSFET 44 is connected to the positive voltage source $V_{dd}$, while the drain 48 provides a buffered output signal. The use of the MOSFET 44 provides a low output impedance device for driving resistive and inductive loads.

Applications of the negative voltage generator of FIG. 4 include generating negative voltages to drive a MOSFET output device with substantially the same source-gate potential for various low voltages. For example, a 5 volt application ($V_{dd}$=5 volt) can develop a source-gate drop of 5 volts by switching the gate so that it is attached to $V_{ss}$. However, in a 3 volt application, the gate must be driven to a negative voltage (−2 volts relative to $V_{ss}$) using a negative voltage generator in order to achieve a 5 volt source-gate potential and similar drive capacities.

The preferred embodiment of the present invention includes a positive voltage doubler circuit 40, which is compatible and can be formed with a standard N-well CMOS process. However, any voltage source having three or more output levels may be used in place of the positive voltage doubler circuit 40.

The negative voltage generator of the present invention operates with two cycles. During the first cycle of operation switches S9 and S10 are closed while switch S11 is opened. This allows the output capacitor $C_{NEG}$ to be charged to a voltage which is positive with respect to its second node 42, which drives the P-gate 43 of the MOSFET 44. During this first phase the MOSFET 44 is turned off because the voltage between its gate 43 and its source 45 is zero volts.

During the second phase switches S9 and S10 are opened and switch S11 is closed. This references the first node 41 of the output capacitor $C_{NEG}$ to $V_{ss}$, usually ground. Because of the change in voltage reference of the first node of the output capacitor $C_{NEG}$ the voltage at the second node 42 becomes negative with respect to the first node 41 which is at $V_{ss}$. The voltage level of the second node 42 has a magnitude of ($V_{dd}-V_{ss}$), but is a negative voltage in relation to $V_{ss}$. This output voltage level is accurate provided that the output capacitor $C_{NEG}$ is large relative to the capacitance at the second node 42 of the output capacitor $C_{neg}$.

During operation, the MOSFET 44 is cycled on and off creating a pulsing output. This pulsing output is useful for many applications, including use as a driver to drive a multi-phase motor. For instance, this circuit is viable for three volt servo and spindle drivers used with disk drives and tape drives. Several negative voltage generators can be used to each drive an individual phase of the motor. The speed of the motor can therefor be adjusted by the adjustment of the oscillator which controls the switches S9, S10 and S11.

The negative voltage generator according to this invention prevents the sizes of p-channel output drivers from necessarily increasing in size due to a reduction in the power supply from five to three volts.

Although the invention has been described in detail with reference to the presently preferred embodiments, it should be understood by one of ordinary skill in the art that various modifications can be made without departing from the spirit and scope of the invention. Accordingly, it is not intended that the invention be limited, except as by the appended claims.

What is claimed is:

1. A voltage generator having a voltage reference, a first positive voltage source and a second positive voltage source that is less than said first positive voltage source, said voltage generator for driving a semiconductor output device with a negative voltage comprising:

a capacitor having first and second electrodes;

a first switch selectively connecting said first electrode to said first voltage source;

a second switch selectively connecting said second electrode to said second voltage source;

a third switch selectively connecting said first electrode to a voltage reference having a voltage different from the first and second voltage sources; and at least one control signal controlling said first, second and third switches in first and second cycles, such that said first switch connects said first electrode to said first voltage source and said second switch connects said second electrode to said second voltage source during said first cycle, and such that said third switch connects said first electrode to said voltage reference, said first switch disconnects said first electrode from said first voltage source and said second switch disconnects said second electrode from said second voltage source during said second cycle, thereby generating a negative voltage with respect to said voltage reference at said second electrode during said second cycle.

2. The generator of claim 1 wherein said first voltage source is greater than the second voltage source.

3. The generator of claim 1 further comprising a voltage increasing circuit for generating said first voltage source from said second voltage source.

4. A negative voltage generator comprising:

a positive voltage doubler connected to a voltage supply ($V_{dd}$) that generates an output doubled voltage that is substantially equal to two times $V_{dd}$;

a capacitor having a first node connected to said output doubled voltage and a second node connected to said supply voltage;

switches that disconnect said first and second nodes of said capacitor from said output doubled voltage and said supply voltage during a first phase and connect said first node during a second phase to ground potential so that a negative voltage is generated on said second node.

5. A voltage generator comprising:

a voltage enhancement circuit connected to said supply voltage that generates an enhanced voltage that is greater than said supply voltage;

a capacitor having a first node connected to said enhanced voltage and a second node connected to said supply voltage during a first phase;

switches that disconnect said first and second nodes of said capacitor from said supply voltage and connect said first node to a reference voltage, that is less than said supply voltage, during a second phase to produce an output voltage that is less than said reference voltage during said second phase.

6. The voltage generator of claim 5 wherein said switches comprise at least one n-channel enhancement mode transistor formed in a p-type substrate, and at least one p-channel enhancement mode transistor formed in a p-type substrate having n-tape wells.

* * * * *

UNITED STATES PATENT AND TRADEMARK OFFICE

CERTIFICATE OF CORRECTION

PATENT NO. : 6,424,202 B2
DATED : July 23, 2002
INVENTOR(S) : Donald M. Bartlett It is certified that error appears in the above-identified patent and that said Letters Patent is hereby corrected as shown below:

Column 6,
Line 26, replace “tape” with -- type --

Signed and Sealed this

Twelfth Day of August, 2003

JAMES E. ROGAN
*Director of the United States Patent and Trademark Office*